US008327942B2

(12) United States Patent
Grimseth et al.

(10) Patent No.: US 8,327,942 B2
(45) Date of Patent: Dec. 11, 2012

(54) METHOD AND AN APPARATUS FOR COLD START OF A SUBSEA PRODUCTION SYSTEM

(75) Inventors: Tom Grimseth, Oslo (NO); Inge Wold, Oslo (NO); John Daniel Friedemann, Gjettum (NO); Christian Borchgrevink, Langhus (NO)

(73) Assignee: Vetco Gray Scandinavia AS, Sandvika (NO)

( * ) Notice: Subject to any disclaimer, the term of this patent is extended or adjusted under 35 U.S.C. 154(b) by 644 days.

(21) Appl. No.: 12/442,507

(22) PCT Filed: Sep. 20, 2007

(86) PCT No.: PCT/IB2007/002743

§ 371 (c)(1),
(2), (4) Date: Mar. 23, 2009

(87) PCT Pub. No.: WO2008/035194

PCT Pub. Date: Mar. 27, 2008

(65) Prior Publication Data

US 2010/0044053 A1 Feb. 25, 2010

Related U.S. Application Data

(60) Provisional application No. 60/846,099, filed on Sep. 21, 2006.

(51) Int. Cl.
*E21B 43/00* (2006.01)
*E21B 37/06* (2006.01)

(52) U.S. Cl. ..... 166/368; 166/344; 166/272.1; 166/304; 166/57; 392/302

(58) Field of Classification Search ..... 166/368, 166/339, 344, 347, 351, 268, 272.1, 302, 166/303, 304, 369, 373, 386, 57–61; 122/412, 122/428; 392/301, 302, 311–314; 219/628–631
See application file for complete search history.

(56) References Cited

U.S. PATENT DOCUMENTS

| | | | | |
|---|---|---|---|---|
| 2,821,205 | A * | 1/1958 | Chilton et al. | 137/13 |
| 2,832,363 | A * | 4/1958 | Wood et al. | 137/1 |
| 3,977,469 | A * | 8/1976 | Broussard et al. | 166/266 |
| 4,745,937 | A * | 5/1988 | Zagustin et al. | 137/13 |
| 4,753,261 | A * | 6/1988 | Zagustin et al. | 137/13 |
| 5,105,843 | A * | 4/1992 | Condron et al. | 137/13 |

(Continued)

FOREIGN PATENT DOCUMENTS

GB 2349944 A 11/2000

(Continued)

OTHER PUBLICATIONS

PCT/ISA/210—International Search Report—Mar. 13, 2008.

(Continued)

*Primary Examiner* — Matthew Buck
(74) *Attorney, Agent, or Firm* — Venable LLP; Eric J. Franklin

(57) ABSTRACT

A method and an apparatus for establishing a hydrate free regime in a subsea production flowline before discharging into the subsea production flowline a production flow of hydrate prone hydrocarbon product pursuant to a shutdown or at an initial start of production. The hydrate free regime is achieved by injecting into the flowline a heated water volume in advance of discharging the hydrocarbon product from the subsea production system.

27 Claims, 6 Drawing Sheets

U.S. PATENT DOCUMENTS

| | | | | |
|---|---|---|---|---|
| 5,335,728 | A * | 8/1994 | Strahan | 166/267 |
| 5,506,391 | A * | 4/1996 | Burayez et al. | 219/772 |
| 5,988,198 | A * | 11/1999 | Neiman et al. | 137/13 |
| 6,053,187 | A * | 4/2000 | Altomonte | 134/169 C |
| 6,644,848 | B1 * | 11/2003 | Clayton et al. | 374/7 |
| 6,772,840 | B2 * | 8/2004 | Headworth | 166/302 |
| 6,776,188 | B1 * | 8/2004 | Rajewski | 137/624.13 |
| 6,939,082 | B1 * | 9/2005 | Baugh | 405/145 |
| 6,955,221 | B2 * | 10/2005 | Bursaux | 166/303 |
| H2139 | H * | 1/2006 | Moore | 165/154 |
| 7,037,105 | B2 * | 5/2006 | Hayes | 432/63 |
| 7,422,063 | B2 * | 9/2008 | Crichlow | 166/302 |
| 7,475,827 | B2 * | 1/2009 | Schmitt | 236/12.11 |
| 7,669,659 | B1 * | 3/2010 | Lugo | 166/345 |
| 7,721,807 | B2 * | 5/2010 | Stoisits et al. | 166/366 |
| 7,992,632 | B2 * | 8/2011 | Bornes et al. | 166/61 |
| 8,038,368 | B2 * | 10/2011 | Luppi et al. | 405/170 |
| 2008/0053659 | A1 * | 3/2008 | Kinnari et al. | 166/367 |
| 2008/0193219 | A1 * | 8/2008 | Luppi et al. | 405/168.1 |
| 2009/0050326 | A1 * | 2/2009 | Grynning | 166/312 |

FOREIGN PATENT DOCUMENTS

| | | |
|---|---|---|
| WO | WO-2004/111519 A1 | 12/2004 |

OTHER PUBLICATIONS

PCT/ISA/237—Written Opinion of the International Search Authority—Mar. 13, 2008.

* cited by examiner

METHOD AND AN APPARATUS FOR COLD START OF A SUBSEA PRODUCTION SYSTEM

CROSS-REFERENCE TO RELATED APPLICATIONS

This claims priority to U.S. provisional patent application 60/846,099 field 21 Sep. 2006 is the national phase under 35 U.S.C. §371 of PCT/IB2007/002743 filed 20 Sep. 2007.

The present invention relates to a method and an apparatus for starting a flow of hydrate prone hydrocarbons through a subsea production flowline from cold condition, pursuant to a shutdown or at an initial start of a subsea production system.

In particular, the present invention relates to a method and an apparatus for hydrate free production of oil dominant hydrocarbons (as opposed to production of essentially dry gas) in long (for instance in the order of 100 km) subsea flowlines. At long distance ranges, steady state hydrate and wax mitigation means are achieved by maintaining hot fluid transfer in a thermally insulated flowline. The invention relates to start up from cold conditions of such a flowline.

BACKGROUND OF THE INVENTION

Transfer of unprocessed oil from a reservoir to a platform over distances up to 25 km is commonplace, and recent projects have implemented schemes for over 50 km. Most such installations use one or several thermally insulated flowline(s) for the purpose of keeping the well fluids hot in the steady state such as to avoid formation of hydrates, wax and asphaltenes.

Most such installations use a dual flowline configuration, thus facilitating circulation of stabilized crude oil in the flowline system prior to a planned shutdown, thereby eliminating sensitivity to the undesirable effects of low temperatures. On restarting production, methanol or other chemical means of hydrate inhibition is injected into the well stream to prevent hydrates as the well stream is cooled by the cold flowline pipe. Alternatively, circulation of hot stabilized crude oil is used to heat the flowlines.

For cases of extreme offsets (say for instance in the order of 100 km) use of a dual flowline system for production (in addition to a water injection pipeline) can be uneconomical.

SUMMARY OF THE INVENTION

An object of the present invention is to provide a more cost-effective method and an apparatus by which a hydrate free regime can be established in the production flowline pursuant to a shutdown, or at an initial start of production.

Another object of the present invention is to provide a method and an apparatus by which the use of chemical hydrate inhibiton means can be avoided in the course of establishing a hydrate free regime in the production flowline, pursuant to a shutdown or at an initial start of production.

Still another object of the present invention is to provide a method and an apparatus by which the use of dual production flowlines can be avoided in the course of maintaining or establishing a hydrate free regime in the production flowline, pursuant to a shutdown or at an initial start of production.

Yet another object of the present invention is to provide a method and an apparatus by which the power rating of any direct electrical heating (DEH) facility installed on the flowline can be reduced.

Advantageously, the method and apparatus of the present invention are implemented for starting from cold condition of a subsea flowline for carrying a hydrocarbon flow, such as a multiphase oil dominant unprocessed hydrocarbon flow, which flowline is, pursuant to a (long) shutdown or at an initial start, charged with injection water from a produced water injection line.

Briefly, the method of the invention is characterized by discharging heated water into the flowline, preferably at large quantities, from a water reservoir, for heating of the flowline prior to discharging into the same line hydrate prone hydrocarbons, such that when hydrocarbons are introduced (at a point in time) into the flowline, a hydrate free regime is established by elevated temperature.

In preferred embodiments, the method advantageously includes one or several of the following steps:

- hydraulically connecting the reservoir to the flowline downstream of the production system or a pump facility providing production flow through the flowline;
- hydraulically connecting the reservoir to a water injection line via a first conduit supplying water to the reservoir for heating;
- mixing the injected volume of heated water, which is discharged from the reservoir via a second conduit, with water that is discharged from the water injection line via a third conduit, preferably by means of an eductor, which is driven preferably by pressure in the water injection line;
- controlling the flow of water into and/or out of the reservoir by means of pressure control valves and/or flow control valves such that the pressure in the reservoir remains essentially constant and essentially at ambient pressure;
- heating the water volume in the reservoir which is equipped with thermal insulation and a heater arrangement, wherein the heater arrangement is arranged on a separately retrievable module including a motor and a pump for circulation of the water;
- providing an inductive circuit for a heater element in the heater arrangement;
- constructing the primary winding of the inductive circuit as a normal transformer winding, forming the secondary as a piece of solid metal, and depositing essentially all the power in the magnetic circuit in the form of heat resulting from eddy currents generated in the solid piece of metal;
- providing a conductive circuit for a heater element in the heater arrangement;
- diverting power to the heater element from a power supply intended for other purpose in steady state operation, such as for the purpose of powering a fluid booster pump or any other electrically powered subsea equipment;
- operating a heater element in the heater arrangement on oxy-hydrogen gas supplied in the form of separate gas supplies for hydrogen and for oxygen, respectively;
- burning of hydrogen in oxygen, and adding the steam product to the water volume in the reservoir;
- connecting the hydrogen and oxygen supply lines to a fuel cell, driving the fuel cell to provide the electrical power required for heating and/or operation control equipment associated with the reservoir and/or the subsea production system;
- including, in the reservoir, a gas phase effective to increase time constants of the pressure control function/pressure control circuit;
- injecting a plug of heated water in advance of production flow through the flowline, the plug having a length in the range of 5-100 km and a water temperature of 90-30° C.

For practicing the method an apparatus is advised for starting, from cold condition pursuant to a shutdown or at an initial start of a subsea production system, a flow of hydrate prone hydrocarbons through a subsea flowline. The apparatus comprises:

- a reservoir containing water;
- heater arrangement effective for heating the water contained in the reservoir, and
- injection means by which a volume of heated water is dischargeable from the reservoir into the flowline to establish, by elevated temperature, a hydrate free regime in the flowline in advance of discharging the hydrocarbon flow from the subsea production system.

In preferred embodiments the apparatus includes one or several of the following features:

- the reservoir is via conduit hydraulically connected to the flowline downstream of the production system or a pump facility providing production flow through the flowline;
- the reservoir is via a first conduit hydraulically connected to a water injection line supplying water to the hot water reservoir for heating;
- heated water discharged from the reservoir via a second conduit is mixed with water that is discharged via a third conduit from the water injection line, and injected into the flowline via a second conduit, preferably by means of an eductor, which is driven preferably by pressure in the water injection line;
- the pressure in the reservoir is maintained essentially constant and at essentially ambient pressure by means of pressure control valves and/or flow control valves controlling the flow of water in and/or out of the reservoir;
- the reservoir is equipped with thermal insulation and a heater arrangement, said heater arrangement being installed on a separately retrievable module including a motor and a pump for circulation of the water;
- a heater element in the heater arrangement is driven by an inductive circuit, said inductive circuit having a primary constructed as a normal transformer winding, and a secondary formed as a piece of solid metal in which essentially all the power in the magnetic circuit is deposited in the form of heat resulting from eddy currents generated in the piece of solid metal;
- a heater element in the heater arrangement is alternatively driven by a conductive circuit into which heater power is diverted from a power supply intended for other purpose in steady state operation, such as for the purpose of powering a fluid booster pump or other electrically powered subsea equipment;
- a heater element in the heater arrangement is driven on oxy-hydrogen gas supplied in the form of separate gas supplies for hydrogen and for oxygen, respectively, the heat being generated by the burning of hydrogen in oxygen and the steam product added to the water content in the hot water reservoir;
- the hydrogen and oxygen supply lines are connected to a fuel cell driven to provide the electrical power required for heating and/or operation control equipment associated with the hot water reservoir and/or the subsea production system;
- the reservoir contains a gas phase effective to increase time constants of the pressure control function/pressure control circuit.

A single flowline concept according to the present invention offers advantages over a dual flowline system, both with respect to heat loss to ambient as well as procurement and installation cost.

Further advantages as well as advantageous features of the invention will appear from the following description and the appended claims.

BRIEF DESCRIPTION OF THE DRAWINGS

The invention is further disclosed below with reference to the appended diagrammatic drawings, illustrating embodiments of the invention that are disclosed as non-limiting examples. In the drawings.

DETAILED DESCRIPTION OF PREFERRED EMBODIMENTS OF THE INVENTION

Figure 1:
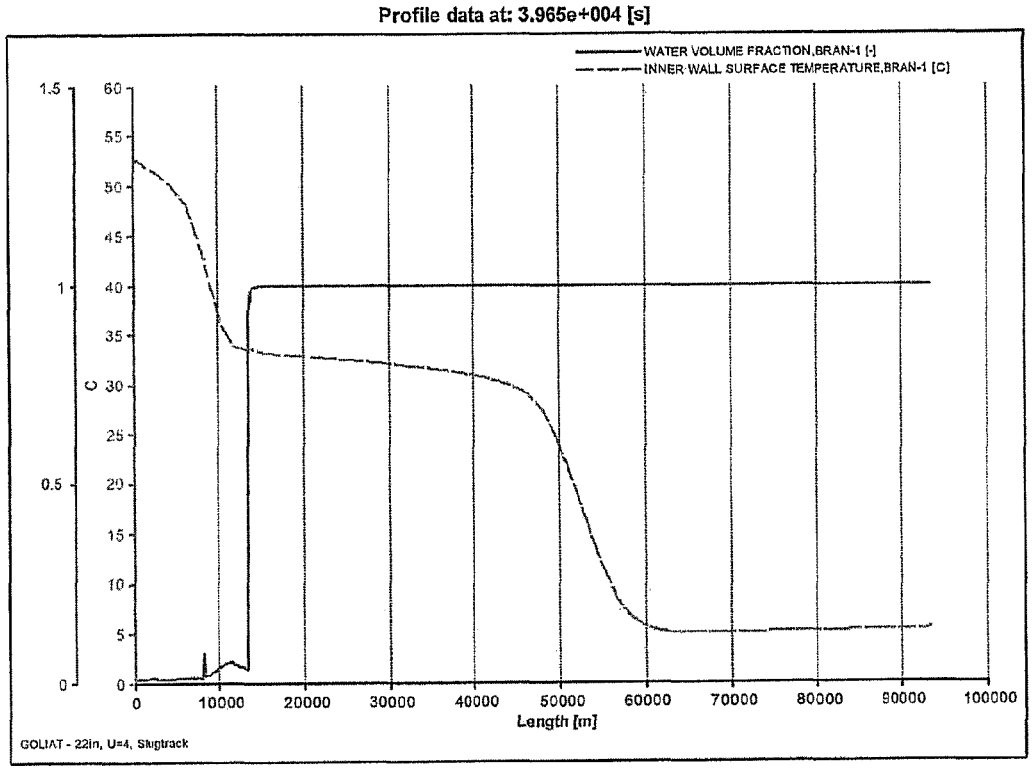
FIG. 1 illustrates the effects of discharging a large slug of hot water into a cold production flowline (11 hours)

Description of the "subsea to beach" production scenario of a specific field under consideration will be used in the following to illustrate use of a heat reservoir in accordance with the present invention. It should be noted that the invention is not restricted to the scenario described, but can be applied to a range of field scenarios and developments with very different parameter values. However, in order to illustrate the technical effect of the invention, a specific case has been selected for the purpose of applying thermodynamic analysis of the achievable technical effects. Comprehensive calculations of flow conditions in a production flowline 12 have been performed by means of widely accepted techniques and tools (OLGA). Thus, the effects of introducing the heated water into the production flowline are well demonstrated for real life conditions.

Characteristics of a prior art scenario which is used herein for illustrating purposes are as follows:

Distance from the subsea production system to landfall: 95 km

One production flowline 12 and one water injection line 10, both 22 inches (approximately 600 mm) nominal diameter Multiphase pump installation 5 and 6 provide the pressure needed for production fluid transfer through the flowline 12

Production flowline 12 insulated to 4 $W/m^2$ deg K

Low flow wellhead pressure and temperature—temperature is sufficient to keep the production fluid free of hydrates in all cases of steady state, but natural pressure is insufficient to propel the fluids to the beach On shutdown (and after a certain cool down time) the production line 12 is circulated by means of water from an injection line 10, using a pig On restart from cold conditions, up to 2,000 $m^3$ of methanol is injected into the production flowline 12, at a cost typically of up to 0.6 million USD, in accordance with a typical prior art start up procedure.

Figure 3:
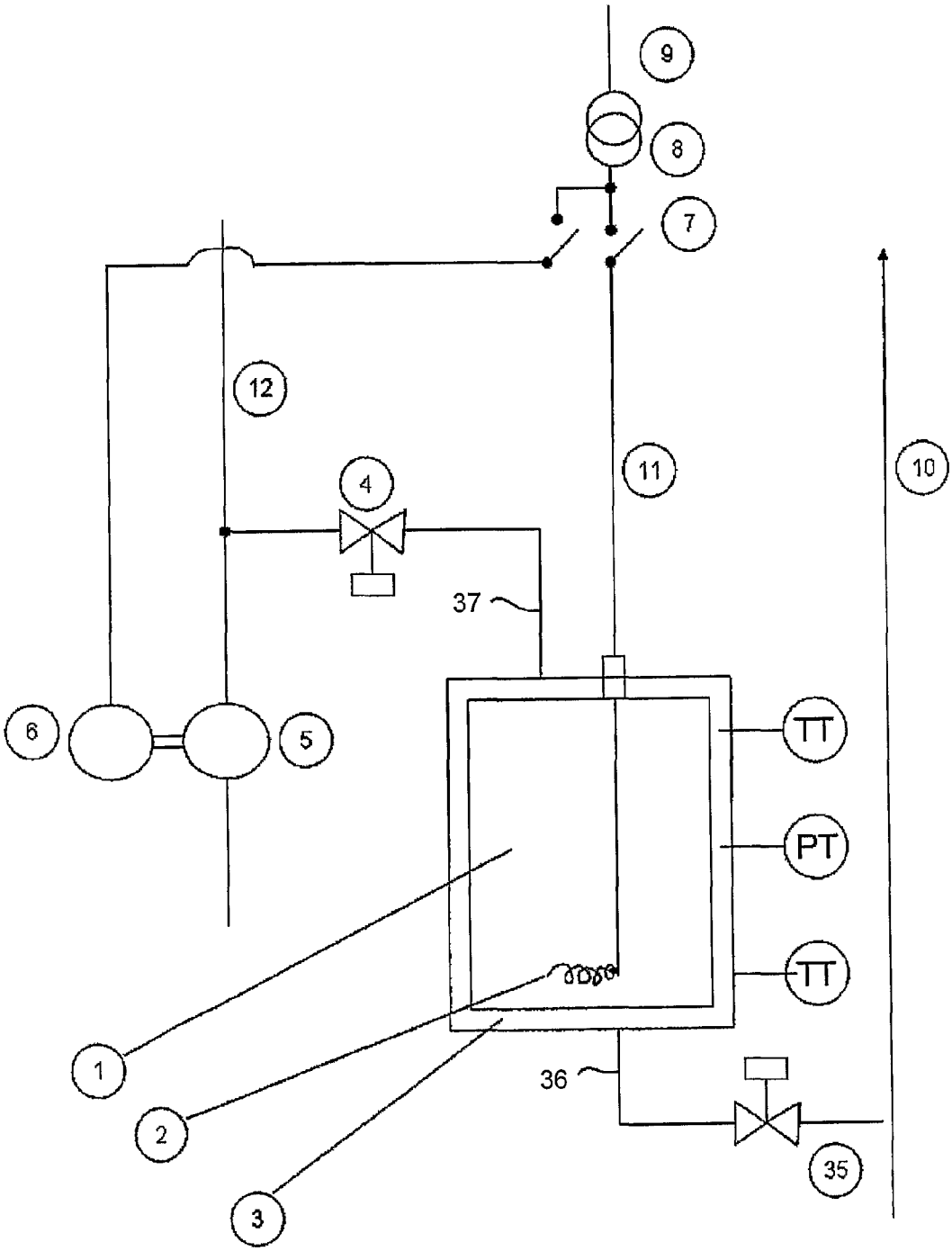
FIG. 3 is a diagrammatic sketch of a heat reservoir connected to a water injection line and to a production flowline, respectively.
Figure 4:
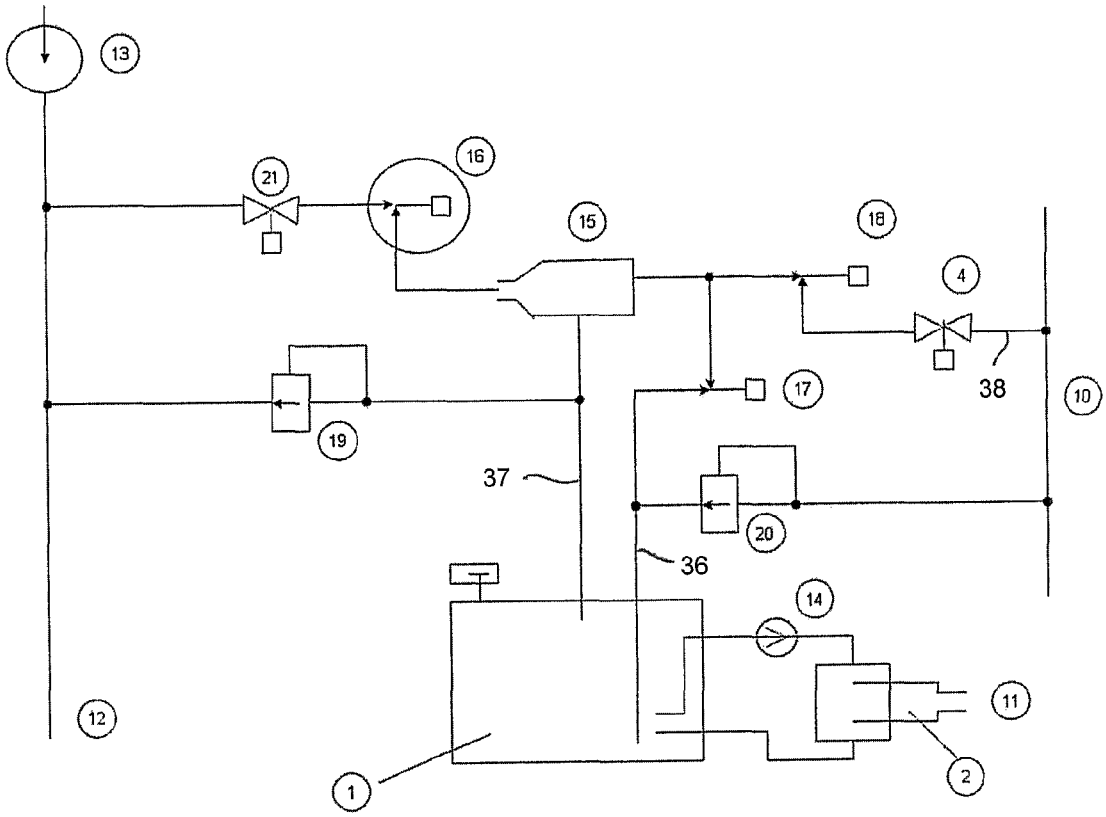
FIG. 4 is a simplified PFD (process flow diagram) showing a heat reservoir tank, heater circuit, and auxiliaries.
Figure 6:
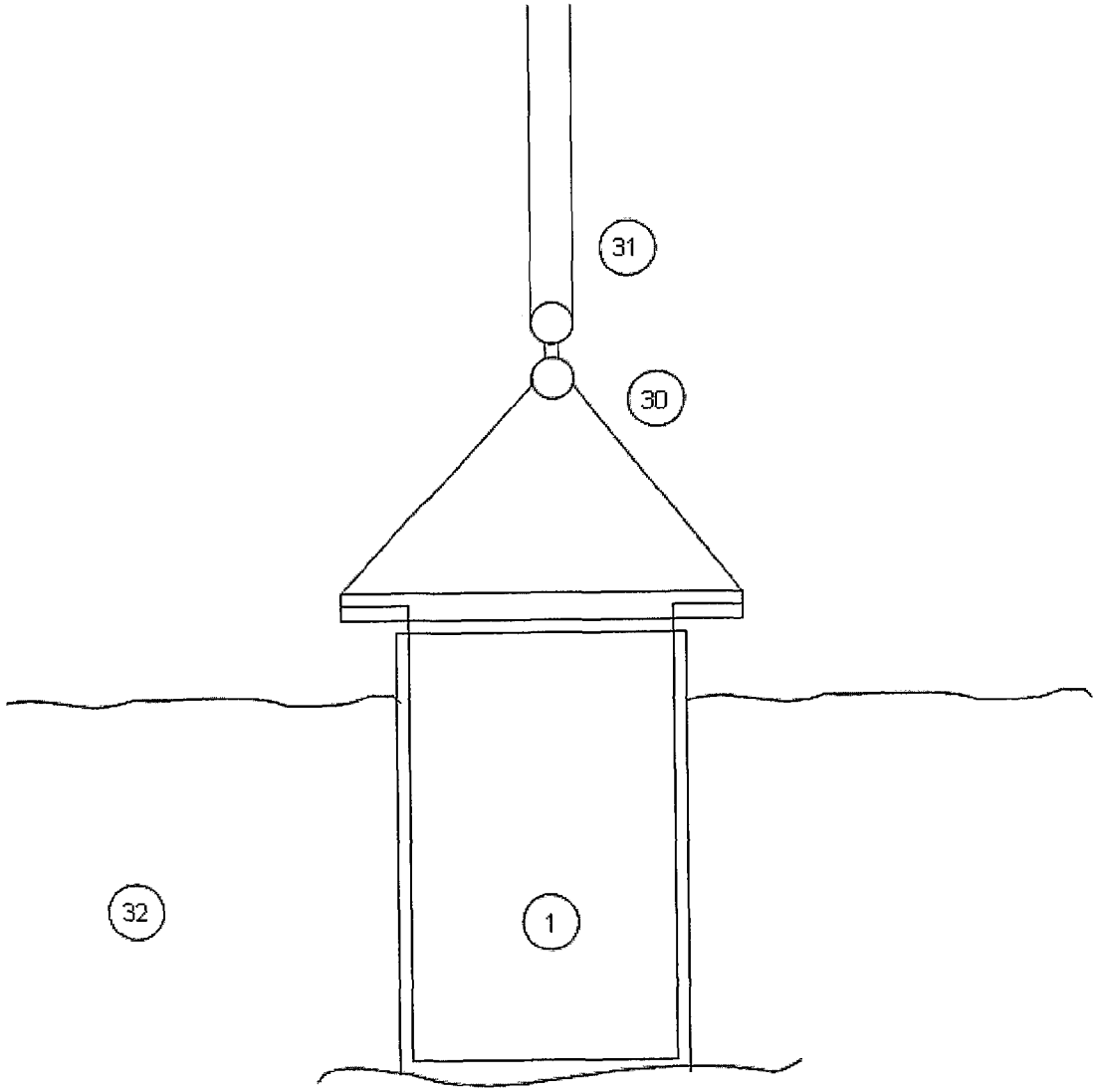
FIG. 6 illustrates a simple installation of the heat reservoir tank.

With reference to FIGS. 3, 4 and 6 of the drawings, an embodiment of the invention preferably comprises an insulated cylindrical tank 1 located close to a subsea production facility 13. This could take the form of a caisson drilled from a drilling rig or a DSV (Diving Support Vessel) and lined with a cylindrical outer wall. The tank is hung off from the outer cylinder, deployed from the drilling rig, preferably using a drill string or from a DSV using the aft deck crane. Moving the cylinder and tank to the drill string interface is by directly lifting these objects from the deck of a supply boat. Assume the volume of the tank is 1,000 m3, e.g. 10 meters (H), by 5.6 meters (radius), alternatively, with a heavy lift in the area installing template structures that facility would be used. A third option is sub surface tow as recently demonstrated in subsea development projects as a cost effective installation method. The tank 1 defines a reservoir containing heated water as will be further explained below.

The bottom of the tank is via a first conduit 36 and a valve 35 hydraulically connectable to the injection line 10, the top of the tank is via a second conduit 37 and a valve 4 hydraulically connectable to the production flowline 12. The tank 1 is during steady state production filled with water at a temperature of e.g. 250° C., assumed heated over a long period of time (while the production is running at steady state) by means of a dedicated power supply line (not shown) at moderate power levels, say in order of magnitude 500 kW. Optionally, on shutdown, the multiphase pump motor power supplies 8 and 9 can be diverted by means of a subsea switching device 7 to supply power to electrical heaters 2 and bring the temperature to the required level, assumed for the purpose of this discussion to be 250° C., which corresponds to a pressure of approx. 40 bara (4,000 kPa), i.e. the ambient pressure at 400 meters water depth for the specific case used in the illustrating example.

When the production is shut down, the flowline 12 is purged with injection water from the water injection line 10. A pig would normally be deployed from a pig launcher (containing a battery of pigs, not shown) to separate the hydrocarbons from the purge water. The flowline 12 in the example has a volume of some 15,000 m3.

By purging the flowline 12 with a 1,000 m3 volume of water at 250° C. from the hot water reservoir 1 mixed with a suitable volume of water from the injection line 10, the combined heat energy content introduced in the flowline 12 will be sufficient to heat the flowline 12 pipe to a temperature suitable for commencement of regular production. The cold water in the injection line 10 is discharged via a third conduit 38 to be mixed with the hot water from the tank 1. Mixing is preferably achieved by means of an eductor 15, which is driven preferably by the injection line 10 pressure, thereby producing water at a temperature which effectively heats the flowline 12. The specific calculation examples presented below illustrate the effects achievable by introducing heated water into the production flowline, as advised herein.

By use of methanol for comparison, and assuming a day late in field life, a worst scenario of methanol injection could be in order of magnitude 2,000 m3 (taken as 25% by volume of the water phase, assumed WC (water cut) at 50%, i.e. around 8,000 m3 of water in the flowline) at a cost of about 600 kUSD. A 50% water cut is in this context a conservative estimate since wells are usually produced to a water cut of 90%.

In terms of OPEX this would suggest advantage in favor of the heat reservoir. In terms of CAPEX the normally large diameter methanol line would have to be compared to a case of a smaller supply line and the sum of tank facilities including subsea power systems and/or manifolding facilities. For long offsets this comparison will normally be in favor of the heat reservoir.

The tank 1 will require substantial thermal insulation 3. In terms of pressure containment the tank is proposed to be pressure compensated with overpressure protection 19 and 20. Since relatively clean injection water is available, minor accidental discharge to ambient is assumed to be acceptable. The tank is thus essentially only required to handle mechanical forces. Accidental overpressure could be external and compensated by injection into the tank 1 of water from the injection line 10, or internal and compensated by bleeding to ambient. The suggested isolation valves 19 and 20 could be controlled from a manifold control pod or from a dedicated pod (not shown). Process connections between the manifold and the tank 1 could typically be in the form of rigid jumpers (not shown, standard subsea equipment), similar to the connections typically used between valve trees and manifolds.

Figure 5:
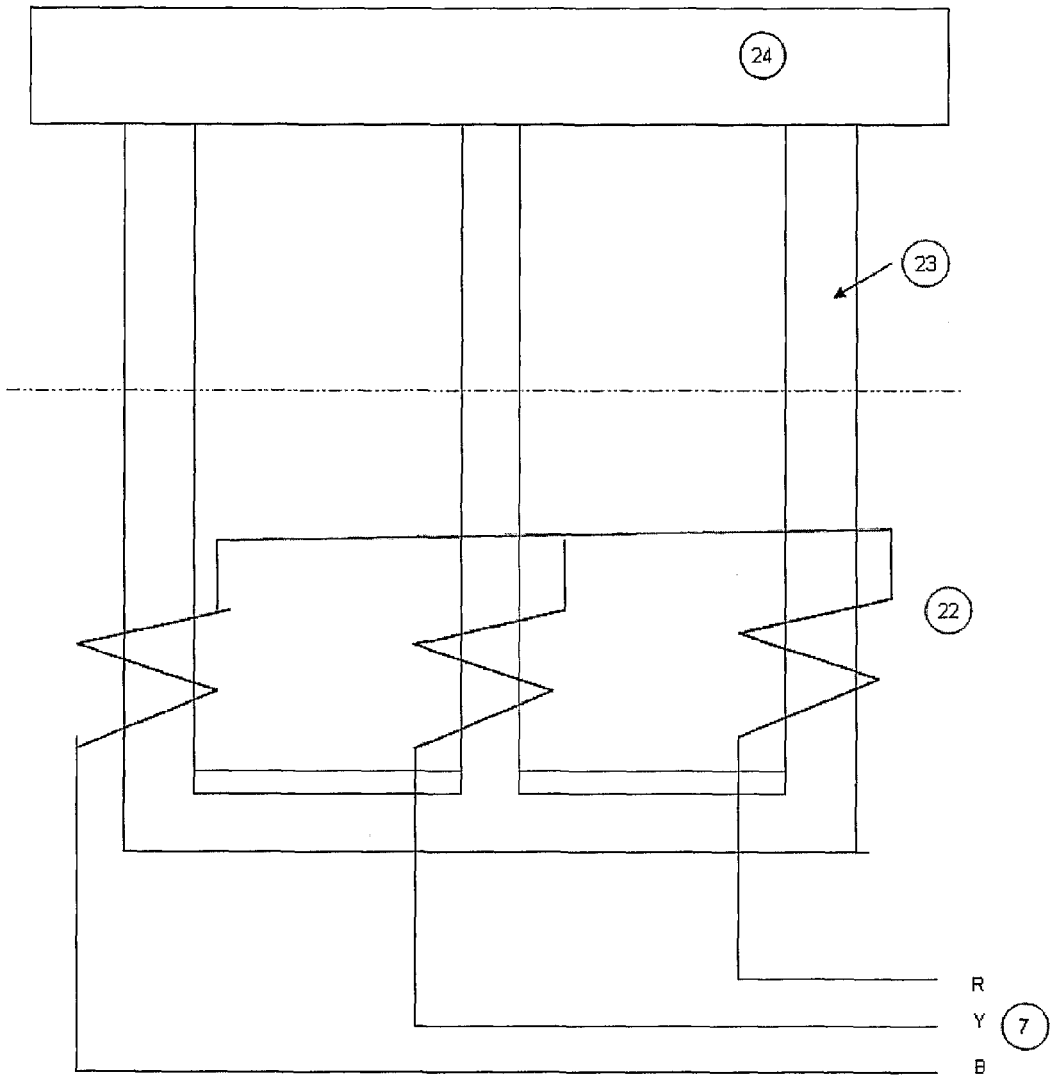
FIG. 5 illustrates the basic principle of an inductive heating circuit.

With reference to FIG. 5, the heater element 2 is, in a preferred embodiment, organized as inductors based on inducing eddy currents into a solid block of steel 24 (similar to a transformer with no secondary winding and having a solid block of steel rather than laminated iron for a core). The primary windings 22 (assumed organized in a three phase configuration) should be made from insulated cable. The inductor windings are at all times located in a cold environment. In the preferred embodiment the entire heater facility 2 with circulation pump 14 and wet mate connector (not shown) is organized as a separate module, which can be retrieved independently of the tank for maintenance. All the process connections and tools required consist of proven subsea designs.

Injection of the 1,000 m3 hot water and the water from the injection line 10 is performed by controlling simultaneously inflow and outflow from the heat reservoir and from the injection line 10 and into the production line 12, respectively. Choke control may be required to be faster than the conventional stepper design and electrical control is visualized. Suitable control valves 16, 17 and 18 are available as proven subsea components.

In a preferred embodiment the entire water slug is injected downstream of the pump facility 5,6 by means of overpressure available in the injection line 10 and the heat reservoir 1, before production pumping is resumed. Injection is performed by means of the eductor 15 which is driven by the pressure in injection line 10, and wherein water from the injection line 10 and the tank 1 is mixed upon injection into the production flowline 12.

EXAMPLE

An example case is analysed in the following for the purpose of illustrating a typical scenario. Obviously the concept also works with other parameter values associated with other scenarios.

Flow Assurance Analysis with Wall Temperature Calculation

| Setup: | |
|---|---|
| Pipeline length: | ~93,000 m |
| ID: | 22" |
| Wall thickness: | 1" Carbon-Steel |
| Insulation: | 1"/2" Polypropylene 680 |
| Ambient water temperature = 4° C. | |
| Overall heat transfer coefficient | |
| 1" insulation: | ~6.5 W/m$^2$K |
| 2" insulation: | ~3.5 W/m$^2$K |
| Water flow: | 0.4 m$^3$/s = 34560 m$^3$/d |
| Flow velocity: | 1.63 m/s |
| Water reservoir: | 1,000 m$^3$ at 250° C. |

Mixing in heat-reservoir water with cold (ambient temperature) water in various ratios gives the following table for mixture temperature and injection length until hot water is exhausted, given the pipe dimension and flow cited above. Fluid flow details for this particular test are as follows:

| Mixing ratio x = Fh/Fc | Hot flow m3/s | Cold flow m3/s | Mix temperature deg C. | Injection time Min | Hot plug length m |
|---|---|---|---|---|---|
| 1 | 0.4 | 0 | 250 | 42 | 4,078 |
| 0.5 | 0.2 | 0.2 | 127 | 83 | 8,155 |
| 0.2 | 0.08 | 0.32 | 53.2 | 208 | 20,388 |
| 0.175 | 0.07 | 0.33 | 47.05 | 238 | 23,300 |
| 0.15 | 0.06 | 0.34 | 40.9 | 278 | 27,184 |
| 0.125 | 0.05 | 0.35 | 34.75 | 333 | 32,620 |
| 0.1 | 0.04 | 0.36 | 28.6 | 417 | 40,775 |
| 0.09 | 0.036 | 0.364 | 26.14 | 463 | 45,306 |
| 0.08 | 0.032 | 0.368 | 23.68 | 521 | 50,969 |
| 0.07 | 0.028 | 0.372 | 21.22 | 595 | 58,250 |
| 0.06 | 0.024 | 0.376 | 18.76 | 694 | 67,959 |
| 0.05 | 0.02 | 0.38 | 16.3 | 833 | 81,551 |

Thermal Analysis

| | | |
|---|---|---|
| Carbon Steel: | | |
| Cp: | 480 | J/kgK |
| k: | 45 | W/mK |
| ρ: | 7,860 | kg/m$^3$ |
| Polypropylene 680: | | |
| Cp: | 2,000 | J/kgK |
| k: | 0.155 | J/mK |
| ρ: | 680 | kg/m$^3$ |
| Water: | | |
| Cp: | 4,200 | J/kgK |
| ρ: | 1,040 | kg/m$^3$ |

A heat reservoir of 1,000 m$^3$ at 250° C. with ambient conditions of 4° C. will have an enthalpy in excess of ~1*10$^{12}$ J.

The iron pipeline in this example will have a total heat capacity of: ~1.6*10$^{10}$ J/K, giving a theoretical (adiabatic) temperature increase of 63 K. Heat loss and heat capacity of the polypropylene insulation will bring this figure down, but the analysis shows that there is sufficient energy available to raise the temperature of the pipe in this illustrating example.

Simulation

Figure 2:
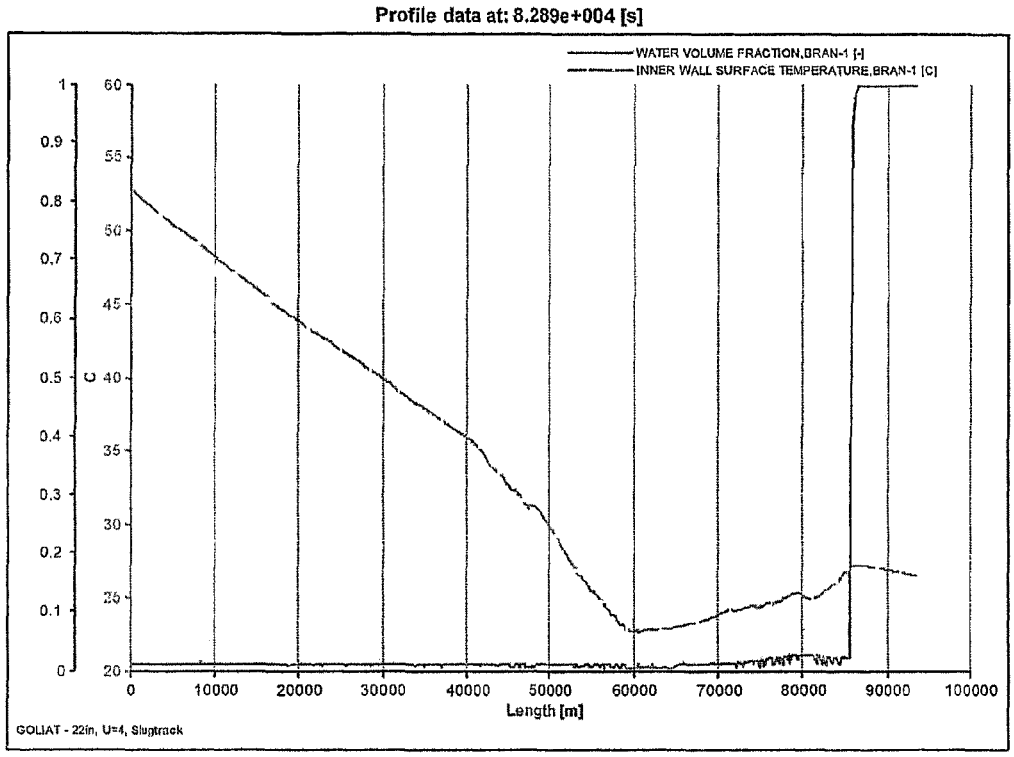
FIG. 2 illustrates the effects of discharging a large slug of hot water into a cold production flowline (23 hours)

Simulations are performed as specified below and illustrated in FIGS. 1 and 2 of the drawings. In FIGS. 1 and 2, the horizontal scale denotes the flowline pipe length in meters, the right vertical scale denotes the pipe inner wall surface temperature in ° C., and the left vertical scale illustrates the water/oil volume fractions of a total flow of 1 (100%).

The simulation was run for three hours with cold water in a cooled down pipeline prior to hot water injection. In the example below, the mixture was chosen such that the water temperature was 34.75° C. Hence, this temperature was maintained for duration of 333 minutes to produce a hot-water plug of 32 km length. After the hot water injection, normal oil production was immediately started.

The production details for this particular test are:

| | |
|---|---|
| Temperature: | 53° C. |
| Flow rate: | 21,383 Sm$^3$/d liquid |
| GOR (GasOilRatio): | 223 |
| WC (WaterCut): | 0.01 |

This particular production fluid, with a high gas content and low water cut, is prone to rapid cooling with associated hydrate formation, due to expansion work and low thermal capacity. Test runs without intermediate heating, i.e. oil production into a cold pipeline, showed that the hydrocarbons in the transition zone were well within the hydrate region, as would be expected.

Simulations wherein a pig was inserted at the water/production switch are also shown. A pig is advantageously used, or else natural gas may encroach into the heated water plug and into the unheated pipe, given enough time/distance.

FIG. 1 shows the inner wall temperature profile for the fluid through the pipeline and the water volume fraction at some time into the simulation. The hot water plug is apparent, followed by the oil. The abrupt transition from water to oil fraction is due to a pig which is run through the pipe to separate the water/oil volume fractions.

In FIG. 2, the same case is shown at a time close to the point where the hot water plug is about to exit the pipeline on the right hand side of the diagram, obvious by the pig-induced water discontinuity. Wall temperature at this point is 27° C.

None of the heated tests came within the hydrate regime, for either insulation thickness.

Optionally, if a fast heating cycle of the heat reservoir water is desirable, the pump installation 5, 6 could be used to provide a faster heating system. By diverting water from the inlet side of the tank 1 (cold water) to the inlet of the pump(s) 5, operating the pump(s) 5 and discharging high pressure water through choke valves (circuit not shown) into the outlet side of the tank (hot water) the full power rating of the pump system 5 could be hydraulically diverted to heating. This would increase the complexity of the manifold piping, valving and insulation system, but is technically feasible and requires only field proven components. Depending on the sand content in the injection water there could be significant wear on the chokes, but the operating times would be of short duration. Several pressure reducing elements in series would reduce wear substantially. The multiphase pump(s) 5 are fed cold water from the bottom of the tank and would have to be monitored closely for hot water at the pump inlet. This action can only proceed to the max operating temperature of the pump units, beyond that point other heating means as described will be employed.

Diverting the electrical power into inductive heaters could also be achieved. This would require a subsea switch unit 7 and substantially inductive based heater element(s) 2. It is assumed that this option is significantly more costly than the hydraulic diversion system, but could go all the way to the suggested 250° C. Alternatively, conductive based heater element(s) could be used.

In terms of control and monitoring, the control of the internal pressure in the tank 1 would appear the most critical. Instrumentation would essentially be pressure and temperature sensors (see PT, TT in FIG. 3)) of common subsea design. As many of the sensors as possible are preferably installed on the separately retrievable heater module.

In a preferred embodiment one or several hydraulic or pneumatic accumulators are mounted low in the tank in the cold section (not shown). Provision of a gas phase reduces the pressure control problem by increasing control time constants.

The invention is of course not in any way restricted to the embodiments described above. On the contrary, many possibilities to modifications thereof will be apparent to a person skilled in the art without departing from the basic idea of the invention such as defined in the appended claims.

BRIEF DESCRIPTION OF THE DRAWING REFERENCES

1 is a tank for storage of hot water
2 is an electrical heater circuit
3 is a thermal insulation
4 is an isolation valve
5 is a multiphase pump or system of multiphase pumps
6 is a drive motor for the multiphase pump
7 are circuit breakers or isolation switches
8 is a transformer
9 is a power supply line (cable) from the beach
10 is a water injection line
11 is a power line supplying power for an electrical heater
12 is a production flowline
13 is a symbolic representation of a subsea production system
14 is a small circulation pump
15 is an eductor
16 is a choke valve or pressure control valve
17 is a choke valve or pressure control valve
18 is a choke valve or pressure control valve
19 is an overpressure relief valve
20 is an overpressure relief valve
21 is an isolation valve
22 represents the primary windings of an inductive heater circuit
23 is a laminated iron core of a three phase inductive circuit
24 is a solid steel rod
30 is a lifting appliance
31 is a drill string or system of wire
32 is the soil of the sea bed
35 is an isolation valve
36 is a first conduit for hydraulically connecting the reservoir 1 and the water injection line 10
37 is a second conduit for hydraulically connecting the reservoir 1 and the production flow line 12
38 is a third conduit for discharging mixing in water from the water injection line 10

The invention claimed is:

1. A method for starting, from cold condition pursuant to a shutdown or at initial start of a subsea production system, a flow of hydrate prone hydrocarbons through a subsea production hydrocarbon flowline, the method comprising:
providing a volume of heated water in a hot water reservoir, and
injecting the volume of heated water from the hot water reservoir into the hydrocarbon flowline to establish, by elevated temperature, a hydrate free regime in the hydrocarbon flowline in advance of discharging in succession into the same hydrocarbon flowline the hydrocarbon flow from the subsea production system.

2. The method according to claim 1, further comprising:
hydraulically connecting the reservoir to the flowline downstream of the production system or a pump facility providing production flow through the flowline.

3. The method according to claim 1, further comprising:
hydraulically connecting the reservoir to a water injection line via a first conduit, supplying water to the reservoir for heating.

4. The method according to claim 3, further comprising:
mixing the injected volume of heated water, which is discharged from the reservoir via a second conduit, with water from the water injection line which is discharged via a third conduit, by an eductor, which is driven by pressure in the water injection line.

5. The method according to claim 1, further comprising:
controlling the flow of water at least one of into or out of the reservoir by at least one of pressure control valves or flow control valves such that the pressure in the reservoir remains essentially constant and essentially at ambient pressure.

6. The method according to claim 1, further comprising:
heating the water volume in the reservoir which comprises thermal insulation and a heater arrangement, wherein the heater arrangement is arranged on a separately retrievable module including a motor and a pump for circulation of the water.

7. The method according to claim 6, further comprising:
providing an inductive circuit for a heater element in the heater arrangement.

8. The method according to claim 7, further comprising:
constructing the primary winding of the inductive circuit as a normal transformer winding,
forming the secondary as a piece of solid metal, and
depositing essentially all the power in the magnetic circuit in the form of heat resulting from eddy currents generated in the solid piece of metal.

9. The method according to claim 6, further comprising:
providing a conductive circuit for a heater element in the heater arrangement.

10. The method according to claim 9, further comprising:
diverting power to the heater element from a power supply intended for other purpose in steady state operation.

11. The method according to claim 10, wherein the diverted power supply is intended for powering a fluid booster pump in steady state operation.

12. The method according to claim 1, further comprising:
operating a heater element in the heater arrangement on oxy-hydrogen gas supplied in the form of separate gas supplies for hydrogen and for oxygen, respectively.

13. The method according to claim 12, further comprising:
burning of hydrogen in oxygen, and adding the steam product to the water volume in the reservoir.

14. The method according to claim 12, further comprising:
connecting the hydrogen and oxygen supply lines to a fuel cell, and
driving the fuel cell to provide the electrical power required for at least one of heating or operation control equipment associated with at least one of the reservoir or the subsea production system.

15. The method according to claim 1, further comprising:
including, in the reservoir, a gas phase effective to increase time constants of the pressure control function/pressure control circuit.

16. The method according to claim 1, further comprising:
injecting a plug of heated water in advance of production flow through the flowline, the plug having a length in the range of 5-100 km and a water temperature of 90-30° C.

17. An apparatus for starting, from cold condition pursuant to a shutdown or at initial start of a subsea production system, a flow of hydrate prone hydrocarbons through a subsea hydrocarbon flowline, the apparatus comprising:

a reservoir containing water;

a heater arrangement effective for heating the water contained in the reservoir, and an injector by which a volume of heated water is dischargeable from the reservoir into the hydrocarbon flowline to establish, by elevated temperature, a hydrate free regime in the hydrocarbon flowline in advance of discharging in succession into the same hydrocarbon flowline the hydrocarbon flow from the subsea production system.

18. The apparatus according to claim 17, wherein the reservoir is hydraulically connected to the flowline downstream of the production system or a pump facility providing production flow through the flowline.

19. The apparatus according to claim 18, wherein the reservoir is via a first conduit hydraulically connected to a water injection line supplying water to the hot water reservoir for heating.

20. The apparatus according to claim 19, wherein heated water discharged from the reservoir via a second conduit is mixed with water that is discharged from the water injection line via a third conduit, and injected into the flowline via the second conduit, by an eductor, which is driven by pressure in the water injection line.

21. The apparatus according to claim 17, wherein pressure in the reservoir is maintained essentially constant and at essentially ambient pressure by at least one of pressure control valves or flow control valves controlling the flow of water at least one of in or out of the reservoir.

22. The apparatus according to claim 17, wherein the reservoir comprises thermal insulation, and wherein said heater arrangement is installed on a separately retrievable module including a motor and a pump for circulation of the water.

23. The apparatus according to claim 17, wherein a heater element in the heater arrangement is driven by an inductive circuit, said inductive circuit having a primary constructed as a normal transformer winding, and a secondary formed as a piece of solid metal in which essentially all the power in the magnetic circuit is deposited in the form of heat resulting from eddy currents generated in the solid piece of metal.

24. The apparatus according to claim 17, wherein a heater element in the heater arrangement is driven by a conductive circuit into which heater power is diverted from a power supply intended for other purpose in steady state operation.

25. The apparatus according to claim 17, wherein a heater element in the heater arrangement is driven on oxy-hydrogen gas supplied in the form of separate gas supplies for hydrogen and for oxygen, respectively, the heat being generated by the burning of hydrogen in oxygen and the steam product added to the water content in the hot water reservoir.

26. The apparatus according to claim 25, wherein the hydrogen and oxygen supply lines are connected to a fuel cell driven to provide the electrical power required for at least one of heating or operation control equipment associated with at least one of the hot water reservoir or the subsea production system.

27. The apparatus according to claim 17, wherein the reservoir contains a gas phase effective to increase time constants of the pressure control function/pressure control circuit.

* * * * *